US005163515A

United States Patent [19]

Tailby et al.

[11] Patent Number: 5,163,515

[45] Date of Patent: Nov. 17, 1992

[54] PUMPDOWN TOOLSTRING OPERATIONS IN HORIZONTAL OR HIGH-DEVIATION OIL OR GAS WELLS

[75] Inventors: Roger Tailby, Ålgård, Norway; Joseph L. Pearce, Dallas, Tex.; John H. Yonker, Carrollton, Tex.; Marion D. Kilgore; Ronald K. Churchman, both of Dallas, Tex.; Jack G. Clemens, Plano, Tex.

[73] Assignee: Den Norske Stats Oljeselskap A.S, Stavanger, Norway

[21] Appl. No.: 689,547

[22] Filed: Apr. 23, 1991

[51] Int. Cl.[5] ..... E21B 23/08

[52] U.S. Cl. ..... 166/383; 166/50; 166/116; 166/153; 166/156; 166/322

[58] Field of Search ..... 166/383, 153, 155, 156, 166/50, 169, 99, 242, 115, 116, 322

[56] References Cited

U.S. PATENT DOCUMENTS

| | | | |
|---|---|---|---|
| Re. 32,336 | 1/1987 | Escaron et al. | 166/250 |
| 1,508,771 | 9/1924 | Boynton | 166/169 |
| 3,051,243 | 8/1962 | Grimmer et al. | 166/224 |
| 3,467,196 | 9/1969 | Kinsman | 166/383 |
| 3,530,935 | 9/1970 | Garrett | 166/153 |
| 3,957,119 | 5/1976 | Yonker | 166/315 |
| 4,027,730 | 6/1977 | Sparlin | 166/156 |
| 4,062,403 | 12/1977 | Sparlin | 166/156 |
| 4,125,162 | 11/1978 | Groves, Sr. et al. | 166/314 |
| 4,362,211 | 12/1982 | Fisher, Jr. | 166/383 X |
| 4,441,558 | 4/1984 | Welch et al. | 166/317 |
| 4,484,628 | 11/1984 | Lanmon, II | 166/250 |
| 4,513,764 | 4/1985 | Yonker | 137/68 |
| 4,527,639 | 7/1985 | Dickinson, III et al. | 166/50 X |
| 4,729,429 | 3/1988 | Wittrisch | 166/65.1 |
| 4,782,896 | 11/1988 | Witten | 166/115 X |
| 4,860,825 | 8/1989 | Corteville et al. | 166/153 X |
| 4,921,044 | 5/1990 | Cooksey | 166/242 X |
| 5,042,297 | 8/1991 | Lessi | 73/155 |

FOREIGN PATENT DOCUMENTS

| | | | |
|---|---|---|---|
| 2170837 | 8/1986 | United Kingdom | 166/99 |

OTHER PUBLICATIONS

S. Hovland et al., "Planning, Implementation, and Analysis of the First Troll Horizontal Well Test", pp. 197–207, SPE 20963, 1980.

*Primary Examiner*—Hoang C. Dang

*Attorney, Agent, or Firm*—Foley & Lardner

[57] ABSTRACT

Pumpdown toolstring for performing operations requiring application of power downhole in horizontal or high-deviation oil or gas wells, comprising an elongate toolstring element (30), locomotive devices (31, 32A) on said toolstring element, with at least one locomotive device (32) provided at a trailing or top end of the toolstring element (30). The toolstring element (30) is tubular and has a closed leading or bottom end, whereas it is open at the opposite, top end. The leading locomotive device, (31) adapted to pull the toolstring element during pumping down, has a seal for co-operation with a seat at a no-go or nipple assembly at the bottom end of a tubing from which an extension tubing extend into the horizontal or high-deviation well. The leading locomotive device (31) sealingly surrounds the toolstring element (30) and allows sliding of the toolstring element there-through when engaging the seat. The toolstring element (30) has a safety bypass valve (80) near the at least one locomotive device (32A) at the top end of the toolstring element and check valve (70) between the bypass valve (80) and the at least one locomotive device (32A).

11 Claims, 10 Drawing Sheets

PUMPDOWN TOOLSTRING OPERATIONS IN HORIZONTAL OR HIGH-DEVIATION OIL OR GAS WELLS

BACKGROUND OF THE INVENTION

This invention generally relates to pumpdown toolstring operations in horizontal or high-deviation oil or gas wells, including operations requiring application of power to operate downhole tools in such wells.

Methods and systems for maintenance and service operations in wells through flow-lines are known in the art. Thus, it is known to employ a toolstring adapted to be pumped down in tubing means with a circulation path including, for example, the annulus between the tubing and a casing in the well. A toolstring of the type contemplated here may be quite long, such as several hundred meters so as to be able to perform operations along the length of the horizontal or highdeviation part of a well, which may extend for as much as 1000 meters from a vertical part or more specifically from a bend part of the well. Known toolstring designs comprise so-called locomotives or piston-like drive means for the pumping action downwards and upwards in the well respectively.

Examples of methods and equipment for performing operations in horizontal or highly deviated wells can be found in U.S. Pat. Nos. 4,729,429, 4,484,628, 4,125,162, 4,062,403, 4,027,730 and 3,957,119. U.S. Pat. No. 4,729,429 involves logging or other measurements in a horizontal or highly deviated production or injection well. According to this patent specification, a wireline is necessary for the intended function. Transport of the wireline along the highly deviated well part or section is achieved by pushing a long tubing element with a locomotive at its top end. Apparently, there will be a problem of buckling of such a long tubing element. Moreover, the fluid displaced below the locomotive must be injected into the surrounding formation. The toolstring is retrieved by pulling on the wireline. It is also to be noted that according to this prior patent operations are performed under wellhead pressure.

U.S. Pat. No. 4,484,628 relates to logging in open or cased wells which may be horizontal or highly deviated. A workstring is used to transport the logging tool to the top of the section to be logged. An electric line is then lowered and pumped down to the bottom of a tubular extension to the tool. This extension is thereafter scoped out of the end of the workstring in order to transport the tool further to the bottom of the section, which is then logged by pulling the tool and extension back into the workstring with the electric line.

The remarks immediately above also apply to a further a U.S. Patent publication, namely U.S. patent reissue No. 32336.

U.S. Pat. No. 4,027,730 describe pumpdown services involving circulation through a length of so-called coiled tubing. This patent specification is particularly directed to means of improving the circulating capabilities of various toolstrings.

U.S. Pat. No. 4,062,403 is somewhat more interesting in connection with the present invention than the patent specifications discussed above. U.S. Pat. No. 4,062,403 also relates to pumpdown services involving circulation through a length of coiled tubing, and is specifically directed to sand washing. Although not mentioned in this patent specification, the techniques described are suitable for horizontal or highly deviated wells, provided that the horizontal length to be traversed is not so long as to induce buckling of the coiled tubing. However, since sand washing is a dominating consideration, a dual tubing string is essential. Such a dual tubing constitutes a severe production restriction for prolific wells. Although the present invention in one embodiment may be employed in connection with dual tubing strings, it is not restricted to such arrangement, and is clearly considered to be of more importance in arrangements with a single production string or tubing and incorporating the well annulus in a complete circulation path. Also of interest is U.S. Pat. No. 3,957,119, showing a type of piston or locomotive for use in pulling a toolstring into tubing below a circulation point, this operation being dependent on the existence of an exit point for power fluid lower in the well. For a typical application, hydrostatic pressure must then be balanced to formation pressure in order to avoid losses to the formation or influx of formation fluids. This is extremely difficult under realistic field conditions, for example due to inaccurate knowledge of reservoir pressure.

U.S. Pat. No. 4,441,558 describes a kind of operation being a typical example of operations with which the present invention is concerned. The same applies to U.S. Pat. No. 3,051,243.

OBJECTS AND SUMMARY OF THE INVENTION

In contrast to the known techniques described in the above patent specifications, the present invention does not employ any wireline for performing the desired operations. Such operations may be to set and pull mechanical locks, circulate fluids at the bottom of the well and take static measurements. The complete toolstring is pumped into and out of the well with no mechanical connection to the surface. Because of the requirement for a large tubing diameter for high productions rates, this invention is based primarily on a single production string or tubing, with return circulation upwards through the well annulus, although essentially the same multiplicity of operations could also be performed by applying the methods of this invention for a well completion involving return circulation through a parallel (dual) tubing string.

However, in the case of a large diameter single tubing completion, it is necessary that the well be hydrostatically overbalanced when the circulation port is not closed off, so that these well service operations are performed in a dead well. Both types of completion require that the tubing must be isolated from the formation during service operations. This is normal practice in connection with through-flow-line and pumpdown operations of the kind contemplated here.

On the background and conditions discussed above, this invention provides for novel and specific features as defined in the claims.

One essential advantage obtained with the invention is that buckling of the long toolstring element or coiled tubing while traversing the horizontal section of the well is avoided by applying most of the hydraulic pumpdown force at the bottom end of the string. Displaced fluid is returned to the surface via the annulus. Moreover, it is possible to generate an axial force in order to actuate tools at the bottom end of the toolstring, also without buckling of the long toolstring element.

BRIEF DESCRIPTION OF THE DRAWINGS

The novel and features of the invention as well as further advantages will be better understood from the following description of exemplary embodiments according to this invention. In the drawings.

DETAILED DESCRIPTION OF THE PREFERRED EMBODIMENTS

Figure 1:
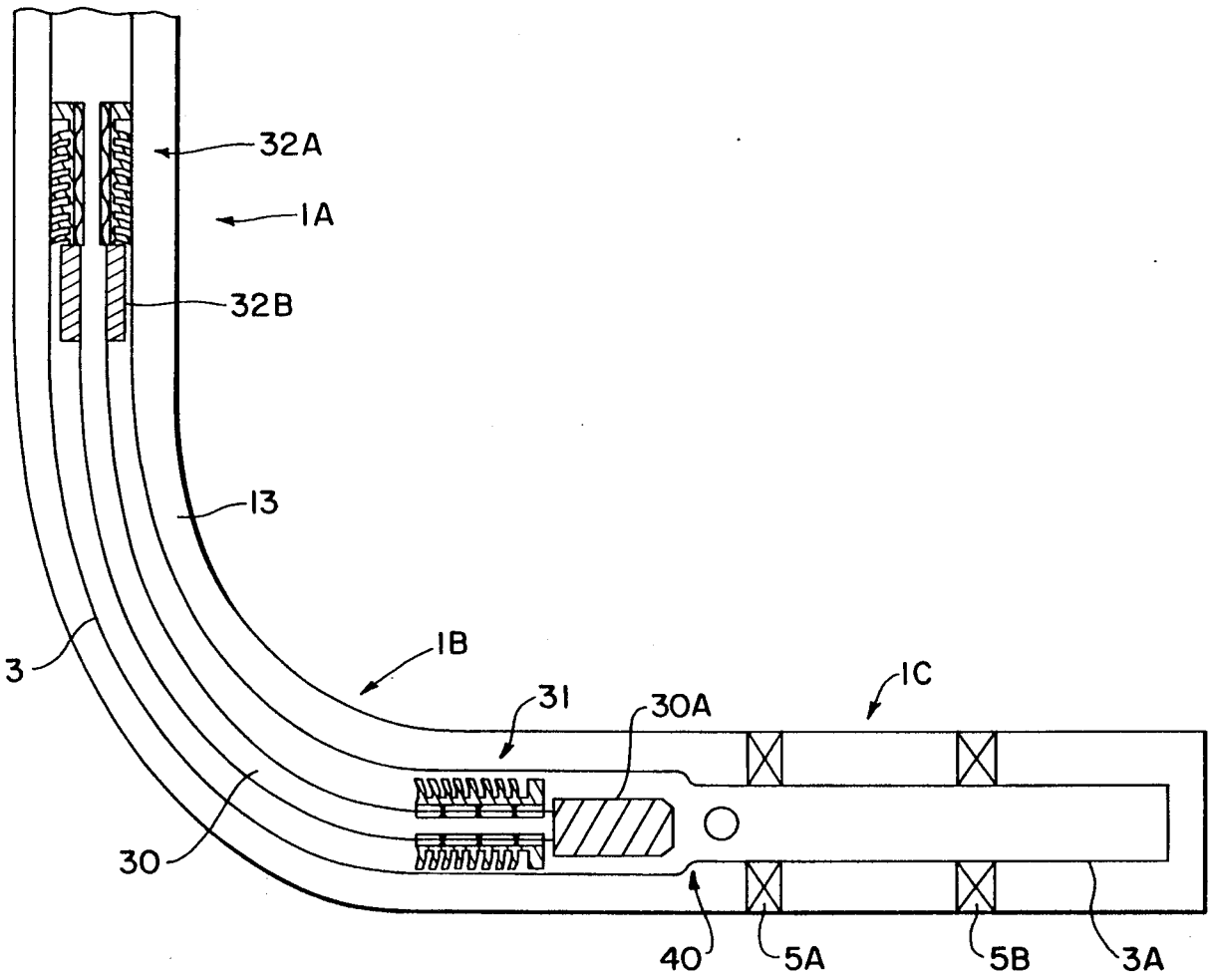
FIG. 1 is a schematic overview of a well during pumpdown transportation of a toolstring therein.

FIG. 1 illustrates a well or well casing comprising a vertical part 1A, a bend part IB and a horizontal or high deviation part 1C. Tubing 3 is installed in the well and has a tubing extension 3A of reduced diameter along a substantial distance within the horizontal well part 1C. For sub-dividing this part into separate production sections, packing means 5A and 5B are shown. As is well known, there may be a number of separate production sections along a horizontal well part, and this invention has particular interest in connection with operations pertaining to this kind of sections. Thus, for example, it is important to be able to select one or more of such sections individually for establishing production conditions.

Within tubing 3 there is shown a toolstring comprising a long tubular toolstring element 30 having an upper or trailing assembly with locomotive or drive means 32A and a valve assembly 32B. Locomotive means 32A serves to pump the toolstring back upwards through tubing 3 when an operation downhole has been terminated. At the bottom or leading end of the toolstring there is another locomotive or drive means 31, which may consist of more than one unit, and a lower assembly or tool package 30A, the latter being composed of tool units or components selected for the operation concerned.

FIG. 1 is intended to illustrate the toolstring during pumpdown or transport into the well, which is performed by applying fluid pressure from the surface in tubing 3 after having established a circulation path in which the annulus 13 between the tubing 3 and the well casing provides for return circulation to the surface. A so-called ported nipple assembly at point 40 forming the transition between the regular tubing 3 and the tubing extension 3A, plays an important role in establishing this circulation path. The ported nipple assembly shall be described more in detail below with reference to FIG. 4 and particular FIGS. 5 and 6.

Figure 2:
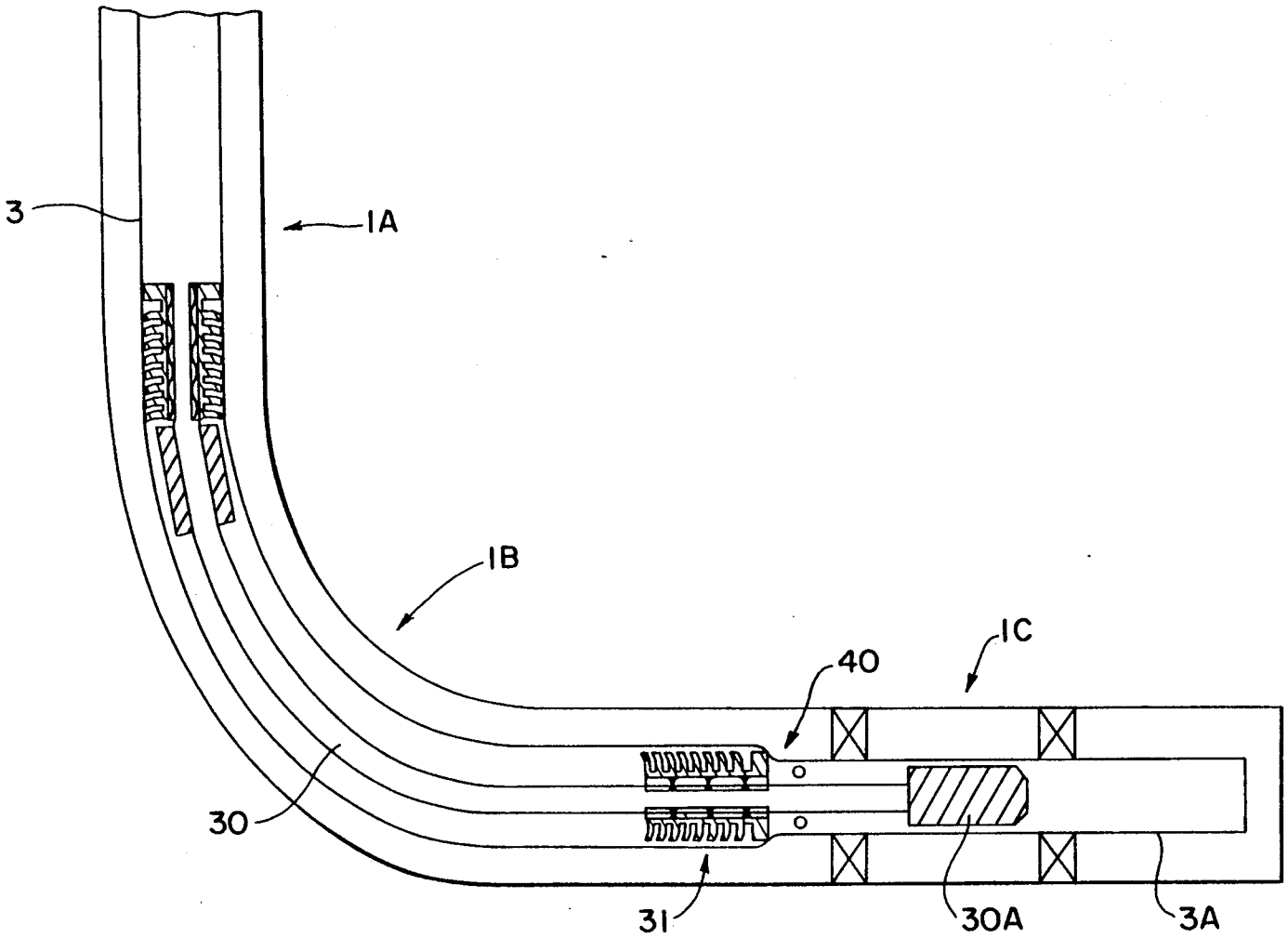
FIG. 2 is a similar overview showing further movement or scoping of the toolstring into a horizontal part of the well.

The transport phase illustrated in FIG. 1 serves to bring the complete toolstring down to the portion of the well in which operations are to be performed, i.e., some point along the length of tubing extention 3A. FIG. 2 in the principle shows how the tool package or head 30A is moved further into tubing extension 3A, which is beyond the circulation point mentioned above.

Figure 2A:
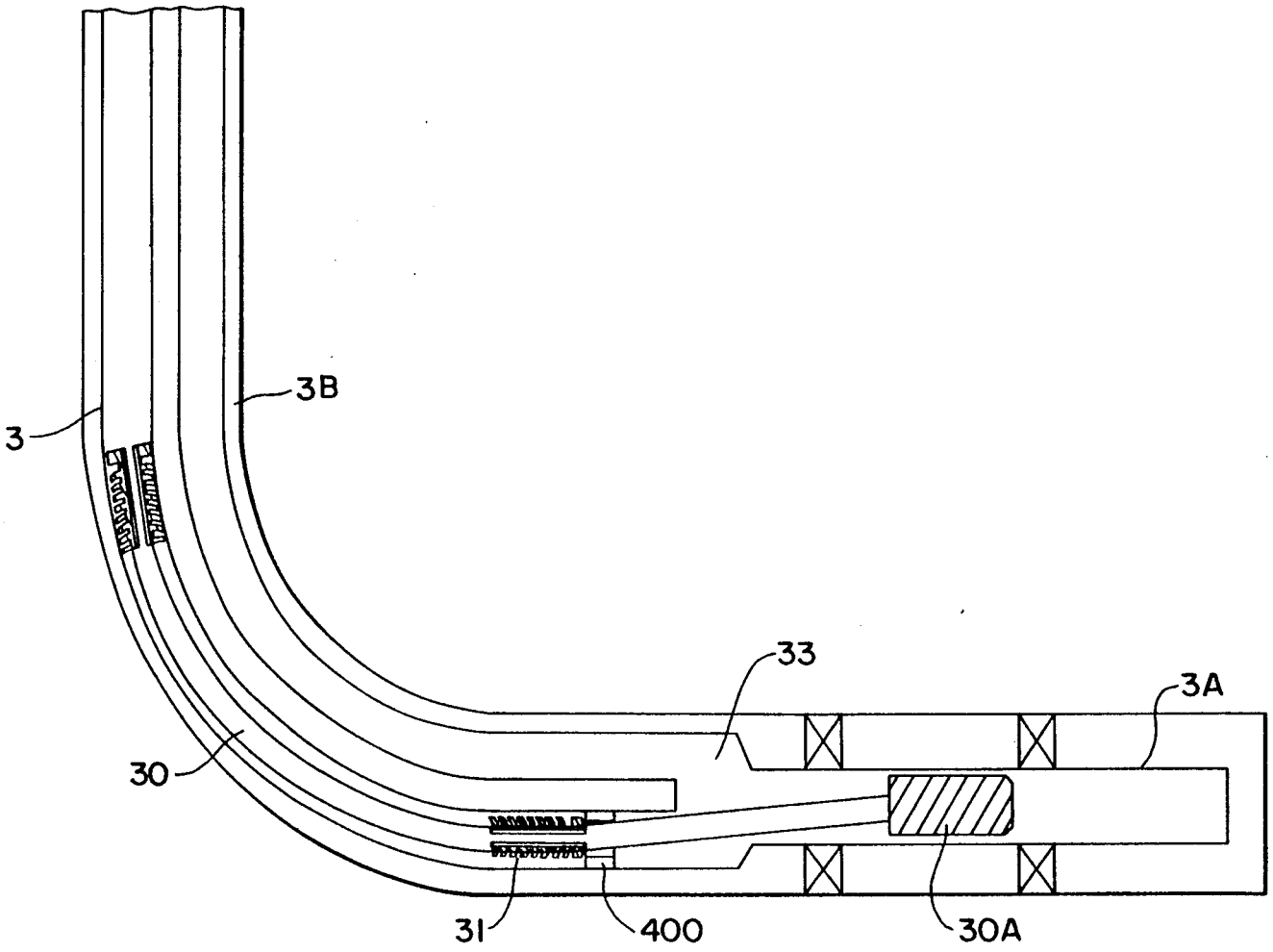
FIG. 2A shows the corresponding operation for the alternate completion comprising two parallel tubing strings.

FIG. 2A shows the corresponding situation when a second, parallel tubing 3C is utilized as the return circulation path instead of the annulus 13. In this case, the circulation function of ported nipple assembly 40 is replaced by a so-called circulation member 33. The no-go and sealing functions of ported nipple assembly 40 are incorporated into tubing 3 immediately above circulation member 33, as indicated schematically at 400 in FIG. 2A. Such functions can be combined in a nipple arrangement well known to those skilled in the art.

Thus, the further movement or so-called scoping of the toolstring into tubing extension 3A is brought about by the pressure applied in tubing 3 and further through the open top or trailing end of the tubular toolstring element 30. In this connection a key feature of this method and system consists in the blocking of the circulation path described, by locomotive means 31 or a unit associated therewith, at point 40 or the ported nipple assembly mentioned above (FIGS. 1 and 2). In FIG. 2A there is a corresponding point 400. When this blocking has been established, tubing pressure from the surface will act on the cross-sectional area represented by the toolstring element 30, in particular at the closed bottom end thereof. As will be further explained below, there is provided for sealing around the toolstring element 30 within the locomotive 31 or associated unit, through which the toolstring element may slide during scoping as mentioned. In other words, the toolstring acts as a long piston during this scoping movement, and since it is closed at the bottom end, the greatest part of that piston effect is applied there, and only the pressure acting on the tubular toolstring cross-sectional area will product a compressive force having a tendency to bring the toolstring element to buckle within tubing 3-3A. However, under normal circumstances and employing a design according to the present invention, this buckling force will not be so great as to permanently deform a correctly designed toolstring.

At this point it should be noted that the comparatively long toolstring element 30, which may have a length of several hundred meters, usually will consist of so-called coiled tubing, i.e., a tubular element being made of such material and having such dimensions as to permit reeling and bending the element during handling and storage, in particular at the surface, in the form of a coil.

A typical example of coiled tubing suitable for this purpose may have an outer diameter of 1.5 inch, an inner diameter of 1.31 inch and a steel strength of 70000 psi. The inner area for differential pressure to act on when pulling the string into the well ks 1.348 sq. in whereas the cross-sectional area generating compressive force is 0.419 sq. in.

Whereas the leading locomotive means 31 during pumpdown or transport of the toolstring into the well (see FIG. 1) has served in the traditional manner as a power piston for pulling the toolstring down into the tubing 3, this piston or pulling effect terminates when locomotive 31 or a unit associated therewith, arrives at the position shown in FIG. 2, i.e. having entered the ported nipple assembly at 40. Then the sealing effect described above, becomes essential to the further pumpdown or scoping of the toolstring with its tool head 30A into tubing extension 3A.

Figure 3:
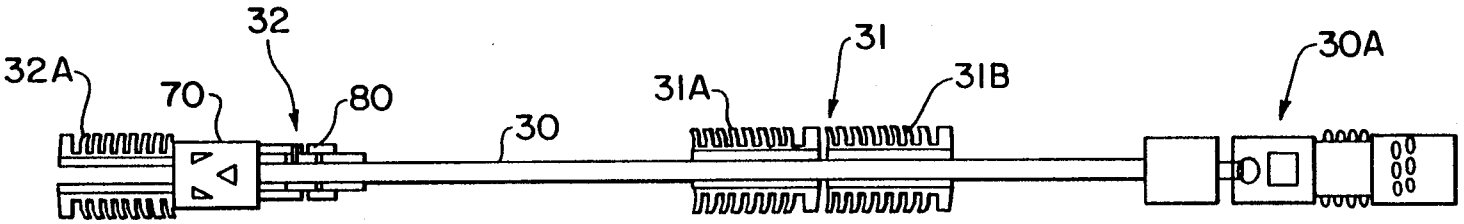
FIG. 3 illustrates the complete toolstring with various assemblies and examples of operating tools thereon, FIG. 4 schematically shows tubing parts within which a toolstring according to FIG. 3 may be transported and operated.

FIG. 3 in some more detail illustrates the toolstring shown schematically in FIGS. 1 and 2. Thus, according to FIG. 3, the tubular toolstring element 30 is provided with an upper assembly comprising a locomotive 32A, a check valve 70 and a safety bypass valve 80. The bottom or leading locomotive means here is shown with two locomotive pistons 31A and 31B, both of which are designed to make possible the above mentioned sliding of the toolstring element 30 therethrough. In view of this the locomotive means 31 may be considered to be a floating assembly in relation to the toolstring element.

Finally, the complete toolstring shown in FIG. 3 comprises a lower or bottom assembly with tool units or components generally denoted 30A corresponding to toolhead 30A in FIGS. 1 and 2. An embodiment of such a lower assembly comprising two components having possible uses also in connection with other forms of toolstrings, than the one described here, shall be explained more closely with reference to FIGS. 9, 10 and 11 below.

Figure 4:
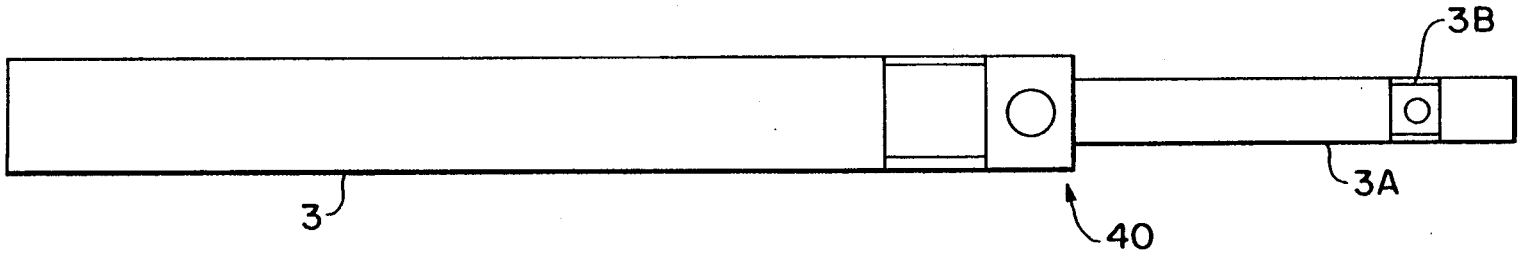

In FIG. 4 there is a schematic illustration of tubing components which may be incorporated in the arrangement of FIGS. 1 and 2, namely tubing 3, ported nipple assembly 40 and the tubing extension 3A. Tubing extension 3A will typically extend for several hundred meters (or even thousands of meters) in a horizontal direction through one or more underground hydrocarbon producing formations. In this tubing extension there is indicated a component 3B which is intended to represent a so-called sliding sleeve or valve which may serve to select production sections as referred to above in connection with FIG. 1. Such sliding sleeve or valve designs for this purpose are well known in the art. See for example U.S. Pat. No. 3,051,243.

Figure 5:
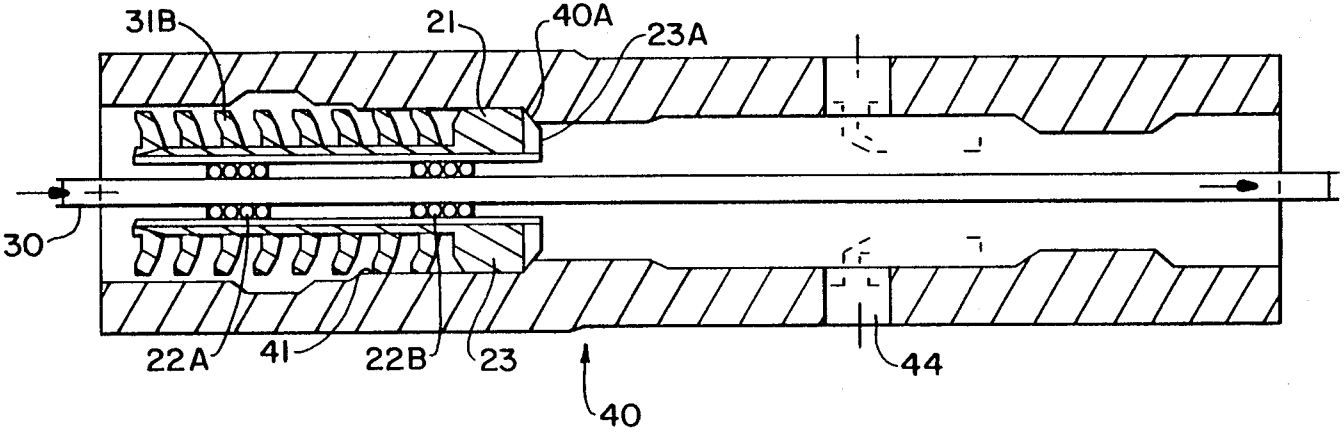
FIG. 5 shows in axial section and at a larger scale a so-called ported nipple assembly in the tubing of FIG. 4, with a toolstring element passing therethrough.
Figure 6:
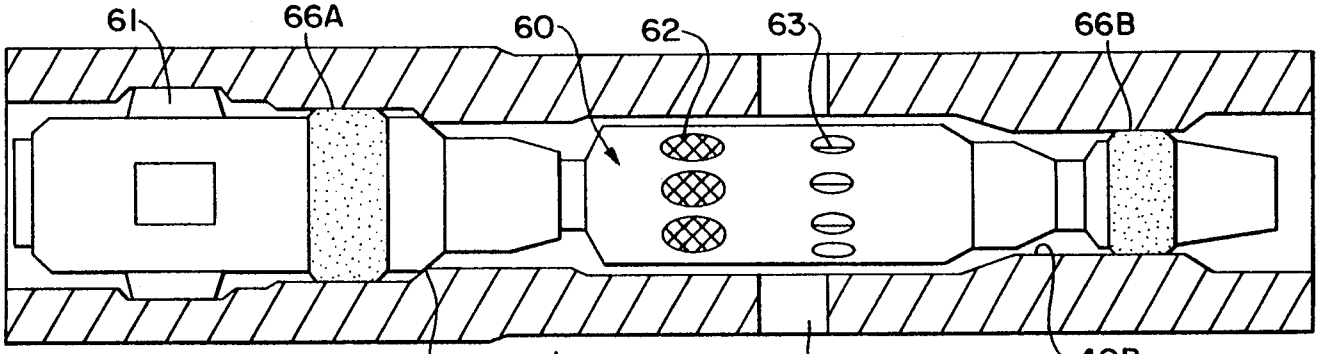
FIG. 6 shows a cross-section of the same ported nipple assembly as in FIG. 5, but here with a conventional circulation control valve installed therein, as required during normal production.

The ported nipple assembly is an element of the tubing string 3-3A which allows utilization of the toolstring pumpdown concept according to the present invention. FIGS. 5 and 6 show this assembly or element in a somewhat detailed axial section, and reference is made first to FIG. 6.

In the normal production mode as shown in FIG. 6, a circulation control valve, generally designated as 60, is set for closing a radial port 44 in the ported nipple assembly, whereas reservoir fluids (e.g. oil) are allowed to flow through the middle of the circulation control valve 60. Details shown in FIG. 6 include a lower seal bore 40B providing a seal surface for a seal 66B on a lower end mandrel of the control valve string. At the opposite end of this valve assembly there is shown a conventional lock mechanism with keys 6 adapted to engage in corresponding recesses 40C in the ported nipple assembly. Correct positioning of the valve assembly 60 within the ported nipple assembly 40 is secured by means of a no-go or stop shoulder 40A with an adjacent seal or packing element 66A which seals in seal bore 41. Ports 62 and 63 are provided in the- main body of valve 60 in order to provide for the required control functions. As mentioned, such circulation control valve 60 is known in the art. See for example U.S. Pat. No. 4,513,764. Circulation control valve 60 may be an evolved form of the valve described in this U.S. patent.

Before the toolstring operation according to the present invention can be initiated, the circulation control valve 60 must be retrieved from the ported nipple assembly or tubing element 40.

In contrast, FIG. 5 illustrates essential features according to the present invention. Here, while performing well servicing by means of the pumpdown toolstring method of this invention, the ported nipple assembly 40 involves an important no-go or stop function at shoulder 40A and has a seal bore 41 upstream thereof, in which the floating assembly mentioned above may seal, more particularly the foremost leading locomotive 31B in the position shown in FIG. 5. A head member at the front end of locomotive 31B constitutes seal means by having a substantially cylindrical outer surface 21 adapted to sealingly engage within the seal bore 41, whereas a front end face 23 with a steel shoe **23*a* is adapted to be stopped against shoulder 40A at the bottom of the seal bore 41. Thus, when seated in this position, the locomotive 31B establishes a stationary seal in relation to the surrounding ported nipple assembly, and a slide seal internally between sealing elements 22A and 22B through which the toolstring element 30 may slide during further scoping or movement into a tubing extension, i.e., to the right as indicated with arrows in FIG. 5. During this operation, the port 44 makes possible a flow of fluids displaced by the length of toolstring element 30 penetrating into the extension tubing. These fluids then flow upwards through the casing annulus outside the ported nipple assembly 40 and the tubing 3 connected thereto (see in particular FIG. 2**).

When the desired operation has been performed, pressure reversing is brought about at the surface and circulation takes place in the opposite direction, i.e., with downflow through the annulus and into the ported nipple assembly 40 through the port 44, whereby pressure is applied directly to the underside of locomotive 31B, thereby unseating it. Reversed circulation is then established and locomotive 32A at the top or trailing end of toolstring element 30 is activated to retrieve the complete toolstring from the well.

Afterwards the circulation control valve 60 (FIG. 6) is usually again run into the well and set in the key recess 40C in the ported nipple assembly 40. The valve is closed by absolute pressure in the normal way after the toolstring running tools are retrieved and the well has been displaced with the correct combination of fluids to allow cleanup and production. At this point a summary of the operations and functions described above with reference in particular to FIGS. 3 and 5, adding some significant details, may be appropriate:

The floating assembly referred to combines the functions of transport of the toolstring into the well and closing the circulation path for the pumpdown concept. It is the blocking of circulation through the ported nipple assembly which decouples the potentially destructive compressive forces applied by the upper locomotive 32A and allows the controlled scoping and axial force generation which makes the whole concept possible.

As already mentioned the floating assembly may consist of a string of separate locomotives 31A, B initially installed on the bottom of the toolstring element 30. Several locomotives may be necessary in order to achieve a balance between pulling exerted by the floating assembly locomotive and pushing by the locomotive(s) 32A at the top of the string. The bottom locomotive(s) 31B may be equipped with a steel, shoe 23*a* which will positively locate at the stop or no-go shoulder 40A of the ported nipple assembly 40. All these floating locomotives can slide along the toolstring element 30, albeit against a considerable amount of seal friction in seals 22A and 22B.

Figure 5A:
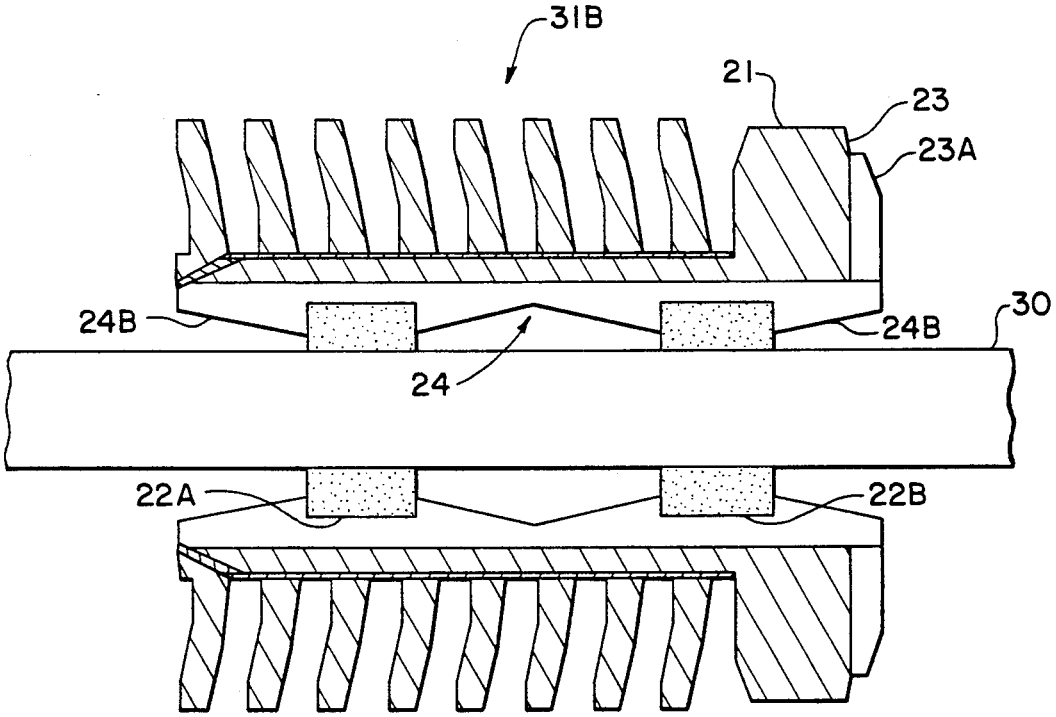
FIG. 5A shows in axial section and at a still larger scale a so-called leading locomotive installed on the toolstring element.
Figure 5B:
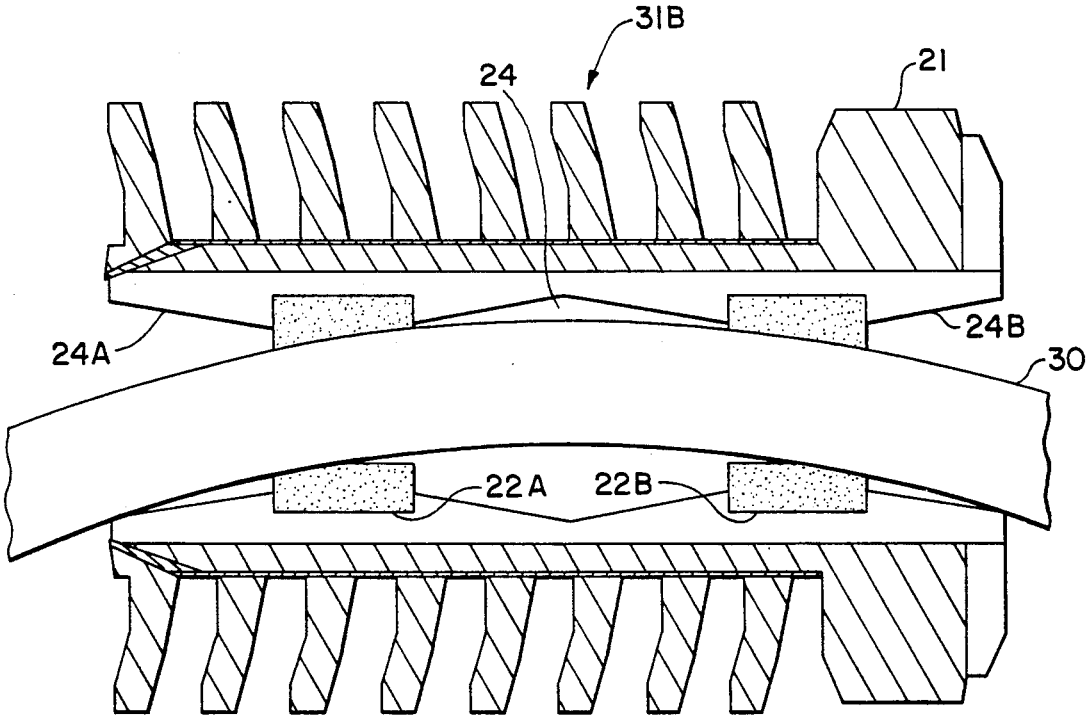
FIG. 5B shows the same components as in FIG. 5A, however with the toolstring element being subjected to bending or bucking.

FIGS. 5A and 5B show details in connection with the internal annular seals 22A and 22B in locomotive 31B. These seals are incorporated into an internal profile 24 of this locomotive, and sealingly engage the coiled tubing or toolstring element 30. Between seals 22A and 22B the internal profile 24 has a widened recess with a significantly larger inner diameter than the inner diameter of the seals. Also, the end portions 24A and 24B of said profile 24 are widened towards the respective end surfaces of locomotive 31B. In this manner an optimum shape of the inner profile 24 is obtained.

The internal profile 24 of the individual elements allows for bending of the toolstring around surface bends and a certain amount of buckling downhole as shown in FIG. 5B. The internal seals 22A, B are positioned such that they will hold pressure under bending and buckling. They are substantial enough to be able to withstand the abrasive effects of scoping up to 1000 meters of toolstring length through them in the course of an operation, as well as to tolerate pressure impulses resulting from surface dents and other irregularities on the coiled tubing.

Scoping is achieved by the head or choke part 21 of the bottom locomotive 31B affecting a pressure-tight seal in the upper seal bore 41 of the ported nipple assembly 40. Along with the internal seals 22A, 22B to the toolstring, this allows pressure buildup on the long piston which the toolstring element 30 now becomes.

Reverse circulation at the end of the operation will push the floating assembly locomotive 31B out of the seal bore 41 and allow the upper locomotive 32A to pull the string out of the well. The individual floating locomotives 31A–31B may well separate along the toolstring element 30 on the trip out of the well, but this will be beneficial when it comes to negotiating surface bends.

Figure 7:
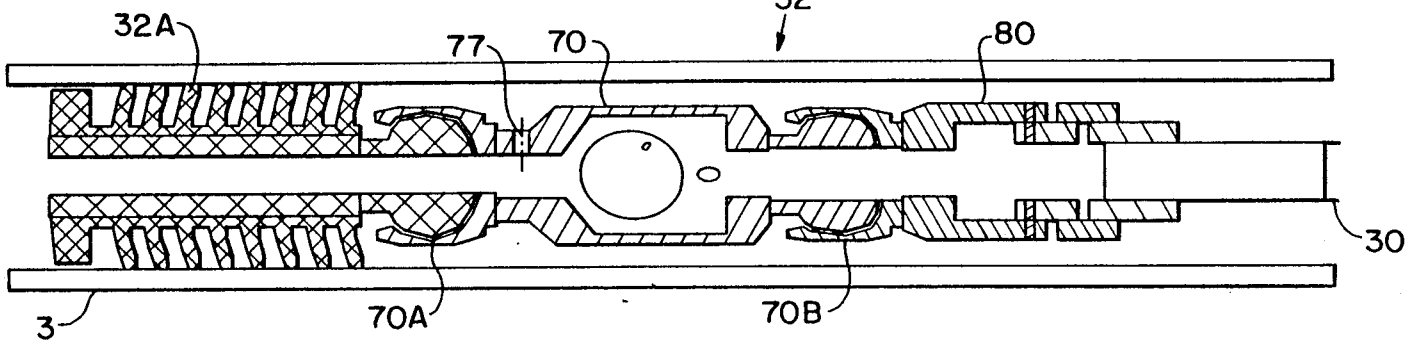
FIG. 7 shows an upper assembly, i.e., at the top or trailing end of the toolstring in FIG. 3, surrounded by a length of tubing, FIG. 8 in axial section shows details of a bypass valve being one of the components in the upper assembly of FIG. 7.

The components normally required in the upper assembly are shown in FIG. 7, i.e., one or more locomotives 32A, a reverse flow check valve 70 and a safety bypass valve 80. The latter is directly connected to the top end of the tubular toolstring element 30. As already explained above the hollow pumpdown locomotive(s) serve(s) to pump the toolstring into and out of the well, and may be capable of generating a sufficient force to bring the toolstring element to buckling and failure. This force is decoupled when the leading or foremost locomotive (31B in FIG. 5) lands in the ported nipple assembly and blocks circulation. Another problem may arise in the event of an obstruction occurring at a point higher in the well, thereby tending to stop the toolstring movement. The resulting compressive force applied to the toolstring may lead to serious failure. In order to avoid this the safety bypass valve 80 is provided at the top of the toolstring element 30.

Figure 8:
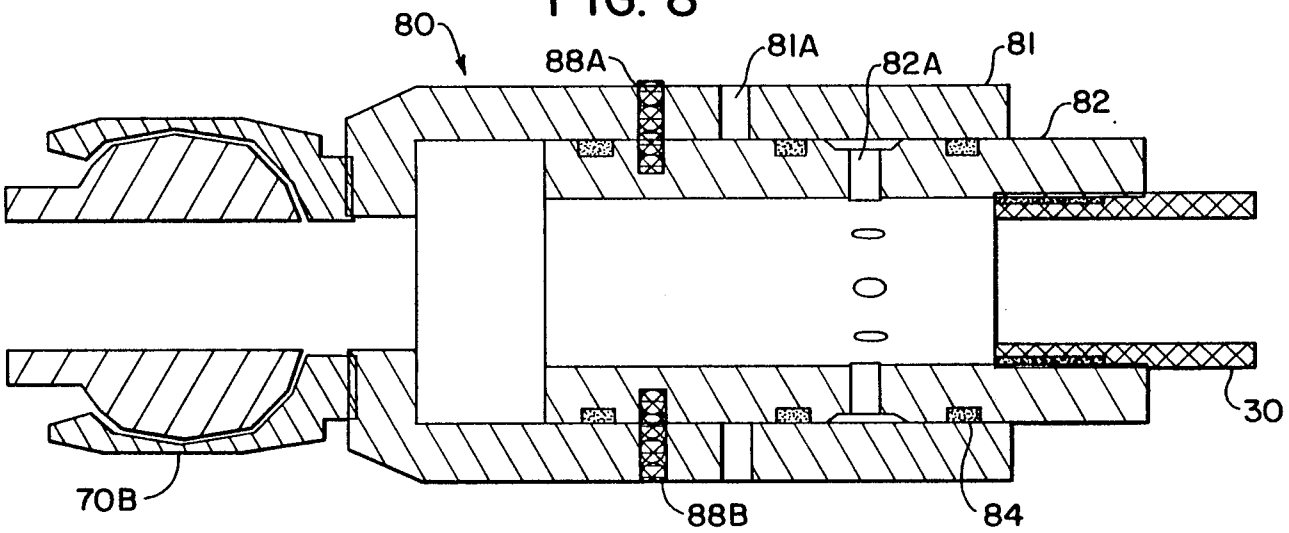

As shown more in detail in FIG. 8 the bypass valve 80 comprises an outer cylindrical housing 81 connected to the check valve 70 by a universal joint 70B, and a cylindrical slide member 82 fitted within the housing 81. The slide member is hollow and is connected to the top end of the toolstring element 30. Mechanical locking means in the form of shear pins 88A and 88B normally keep the housing 81 and the slide member 82 in a fixed relative position and are able to transfer a certain maximum compressive force axially through the bypass valve. However, when this axial compressive force exceeds a predetermined magnitude, shear pins 88A and 88B are broken and relative axial movement of the two bypass valve parts may take place. Accordingly, an increased compressive force will move the slide member 82 further into (to the left in FIG. 84) housing 81, reaching a position in which radial orifices 81A in the housing and 82A in the slide member coincide. Therefore a fluid passage is established from the inside to the outside of the tubular string element 30, as a consequence of which the excessive pressure and therefore compressive force are released.

In other words, the released position of the bypass valve 80 will permit fluid flow through the hollow centre of locomotive 32A, through the open orifices 81A and 82A in the valve and to the outside of the tool-string element 30. The upper locomotive 32A will then have no differential pressure across it and will not be able to generate large axial forces, and the operator of the toolstring operation will have sufficient indication of changing pressure and flow rate to be able to analyse the problem and avoid further loading of the toolstring. Not shown in FIG. 8 is a means to prevent the two halves of the bypass valve from separating after the pins 88A and 88B have sheared.

Then the check valve 70 and a bleed orifice therein (to be described further below) will allow the toolstring as a whole to be pumped out of the well.

An important detail regarding the anchoring of the top end of toolstring element 30 in the slide member 82, may be a tapered, cylindrical adapter of titanium or some other strong, flexible metal and a length of for example 50 cm. Such an adaptor will assist in obtaining a correct alignment of the top end of the toolstring element 30 in relation to the slide member 82 without any undue loading of the toolstring element itself whether this adopts a straight, bent or spiral configuration in the vicinity of the bypass valve 80.

The check valve 70 in the upper assembly 32 is necessary if the bypass valve 80 is opened (released) or if the toolstring element 30 ruptures in the well, and it is desired to have the toolstring pumped out of the well. For such a pumpup operation it is required to establish a fluid pressure within tubing 3 so as to drive the upper assembly locomotive 32A upwards, which of course requires a closing of the internal upward circulation path through the bypass valve 80 and the hollow locomotive 32A. The closing of this leakage circulation path is provided by the check valve 70. This valve may be a known or standard oilfield component which, however, in connection with this invention, is used in a new application.

As shown in FIG. 7, the top end of check valve 70 has a bleed orifice 77 which constitutes a restricted fluid communication means between the inside and the outside of the tubular toolstring element 30. In the present novel method of scoping the toolstring element 30 through the floating assembly or foremost bottom locomotive 31B (FIG. 5) the bleed orifice 77 is an important detail. Thus, when scoping commences the fluid trapped on the outside of the toolstring element and between the top and bottom locomotives, must be able to escape. This is performed by the bleed orifice 77 allowing the fluid to bleed back into the inside of the toolstring element while the toolstring is slowly scoped into the lower part or extension tubing 3A in the well. The size of the bleed orifice 77 must be large enough to ensure an acceptable scoping speed at a reasonable differential pressure.

Upon reversing the circulation in order to retrieve the toolstring, the bleed orifice 77 will allow non-productive flow which bypasses the upper locomotive(s) 32A. For this reason the orifice size must be limited and must not be allowed to increase due to fluid erosion. The orifice should therefore be provided in the form of a replaceable member and made of erosion-resistant material.

Figure 9:
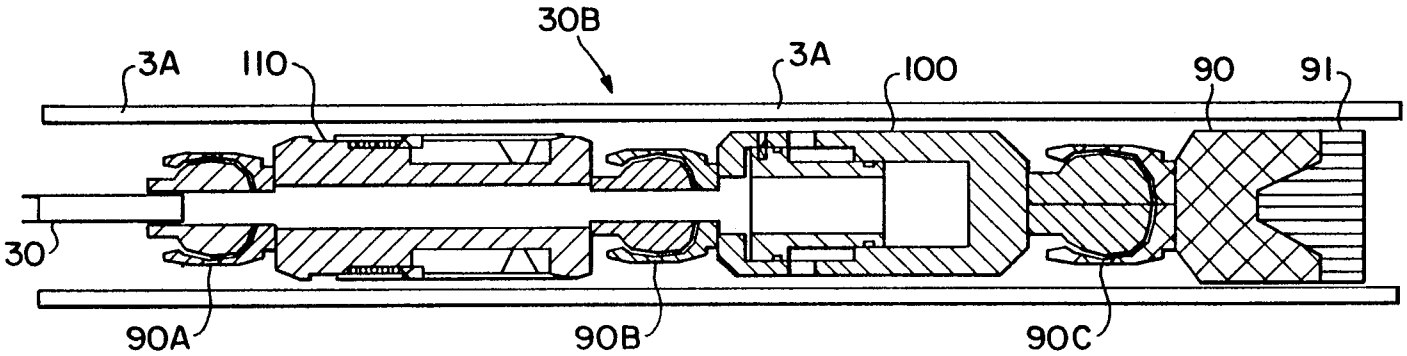
FIG. 9 illustrates examples of components which may constitute a lower assembly, i.e., at the lower or leading end of a toolstring adapted for certain operations downhole, FIG. 10 in axial section shows a circulation valve which is included in the lower assembly of FIG. 9.

A particular embodiment of a lower assembly or tool package for the toolstring is shown in FIG. 9. Included therein from left to right (towards the bottom end of the toolstring) there are provided a sample acquisition unit (so-called junk basket) 110, a tool-string circulation valve 100 (not to be confused with the circulation control valve 60 shown in FIG. 6) and a terminating head 90 with a lead impression block 91, this latter unit being of well known design. These components or units are connected to each other and to the bottom end of the toolstring element 30 by means of traditional universal joints 90A, 90B and 90C. Such a lower assembly 30B may be adapted for scoping or movement into an extension tubing such as tubing 3A in FIGS. 1, 2 and 4, so as to perform operations therein.

The toolstring circulation valve 100 is an essential element in connection with the present inventive concept, where horizontal or highly deviated wells are serviced under zero wellhead pressure. It should be noted, however, that this particular valve unit may also be used with other types of toolstring and pumpdown methods.

The first step in such a service operation is to circulate the well dead, i.e., removing all formation fluids or products from the well and then closing the well off from the surrounding formations. Circulating the well dead is effected through the ported nipple assembly described above. However, there is often a considerable volume of well fluid in the extensión tubing fluid production interval below the circulation point (40, FIGS. 1 and 2), which is not circulated out. A logical first operation is therefore to run in the pumpdown toolstring and circulate out this fluid before it migrates up the hole and causes a pressure imbalance. This operation may typically be combined with a gauge run to ensure that the fluid production interval is free from obstructions.

However, scoping the gauging tool to the bottom requires that the bottom of the toolstring element 30 is closed off as described above, so a toolstring circulation valve 100 is necessary in order to be able to circulate only after scoping is complete.

This particular valve 100 (FIG. 10) consists of a cylindrical housing 101 with one or more radial ports 101A around a circumference. These ports are isolated from the inside by a shear pinned sleeve or slide member 102, with O-rings 104A, B straddling the ports. These O-rings are located on different diameters, so a piston is formed when internal pressure is applied. This pressure application should be effected after scoping is complete. Mechanically breakable locking means in the form of shear pins 105A and 105B normally keep the cylindrical housing 101 and the piston-like slide member 102 in a relative position where fluid communication through the radial port 1O1A is prevented. Upon sufficient differential pressure application, however, the pins 105A, B will shear and the slide member or piston 102 moves and uncovers the ports 101A. Circulation is achieved and this will be apparent to the operator. A snap ring (not shown) holds the piston in the open position.

Reverse circulation through an open valve 100 is prohibited by the check valve in the upper assembly described, such that the upper locomotive(s) 32A can retrieve the toolstring to the surface, when desired.

The toolstring circulation valve 100 can also be used to convey acid for dissolving scale or for spotting other chemicals to be injected into the surrounding formation through an injection valve. In conjunction with a sample acquisition unit (junk basket) to be described below, a sample of sand or other obstructing debris may be obtained.

Like the toolstring circulation valve 100, the sample acquisition unit 110 in the lower assembly of FIG. 9 may be employed in connection with other types of toolstrings than the one described above. A more detailed illustration of the sample acquisition unit 110 is found in FIG. 11.

The sample acquisition unit 110 (junk basket) is a device run immediately above a toolstring circulation valve and will capture a sample of particulate matter like sand, rust or baryte and retrieve it to the surface.

Figure 11:
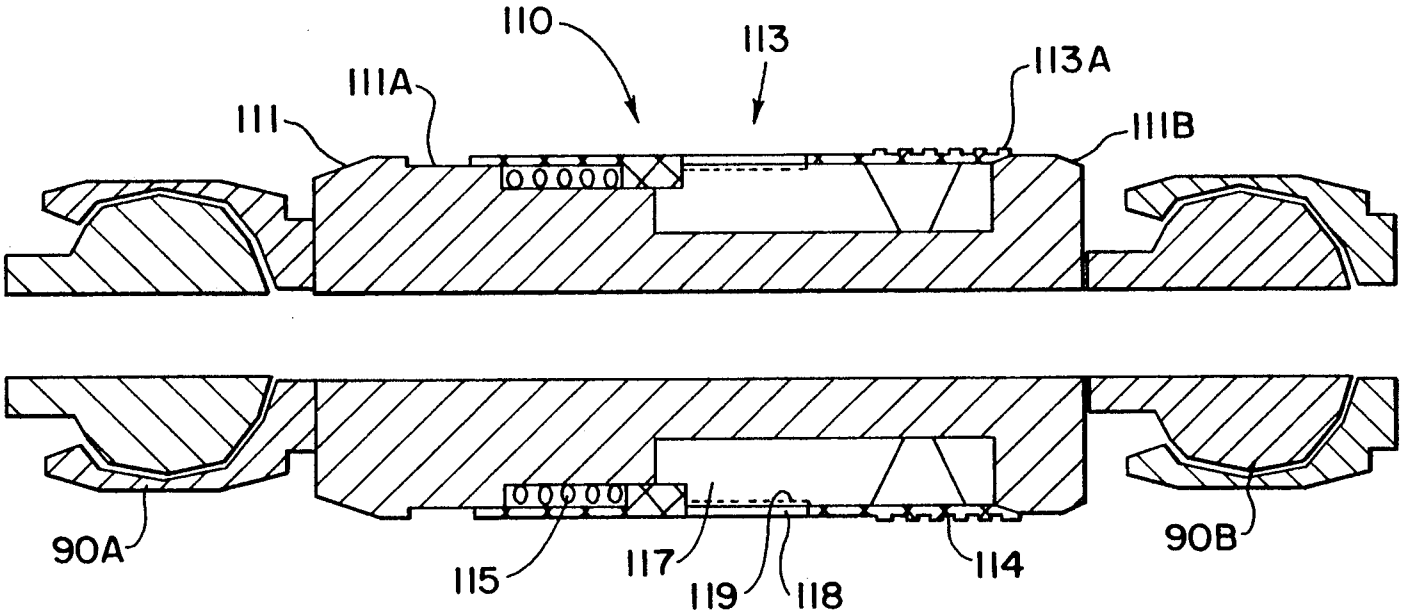
FIG. 11 shows a sample receiving unit (so-called junk basket), being one of the components in the lower assembly of FIG. 9.

Since the pumpdown toolstring method contemplated here is primarily intended for horizontal or highly deviated wells, the sample acquisition unit is designed to scoop up debris from the low side of the hole or tubing. This is achieved by a spring-loaded basket-like unit with a slightly larger outer diameter than a fixed nose part of the unit. Thus, more specifically, the unit comprises a central body member 111 adapted to be mechanically connected to the toolstring and having a reduced diameter recess part 117 forming a chamber or basket cavity for containing samples as mentioned. Displaceable cover means in the form of a cylindrical sleeve 113 is provided for normally closing off the recess or basket part 117 from the environment, but the cover may be opened for letting sample material enter into the recess part 117. For this purpose compression spring 115 is arranged axially between shoulders on the body member and the cover sleeve 113 respectively, urging the latter to a closed positioned as shown in FIG. 11. The cover sleeve 113 may, however, be pushed axially (to the left in FIG. 11) against the force of the spring 115, so as to open an inlet passage between a tapered tip portion 113A of the sleeve 113 and the fixed nose part 111B of the body member 111.

In operation, when moving the unit 113 in axial direction (to the right in FIG. 11) this cover or basket 113 drags on the bottom of the hole and is pushed back against its spring 115 as the toolstring 30 is transported along a horizontal well section. Debris accumulated in this fashion will be retained in the basket recess part 117 by a fine screen 119 covering fluid exit slots 118.

When scooping, the spring 115 will return the basket cover 113 to its closed position, sealing the bottom inlet. Typically at this point circulation will be established by opening circulation valve 100 lower in the string. The resulting fluid flow will generate an axial force by means of a plurality of labyrinths or circumferential grooves 130 formed on the exterior of cover 113. For this effect to occur, the maximum outside diameter of labyrinth grooves 130 should be carefully selected to be compatible with the minimum inside diameter of tubing extension 3A. At such downhole location fluid flow between labyrinth grooves 130 and the interior wall of tubing extension 3A will slide cover 113 to its open position giving access to recess 117 and thereby compressing spring 115. More debris may then be collected, carried in by the circulating fluid.

When circulation ceases, the spring 115 will again close the bottom inlet, retaining the sample for analysis prior to curative measures like spotting acid or running other tool units.

Figure 10:
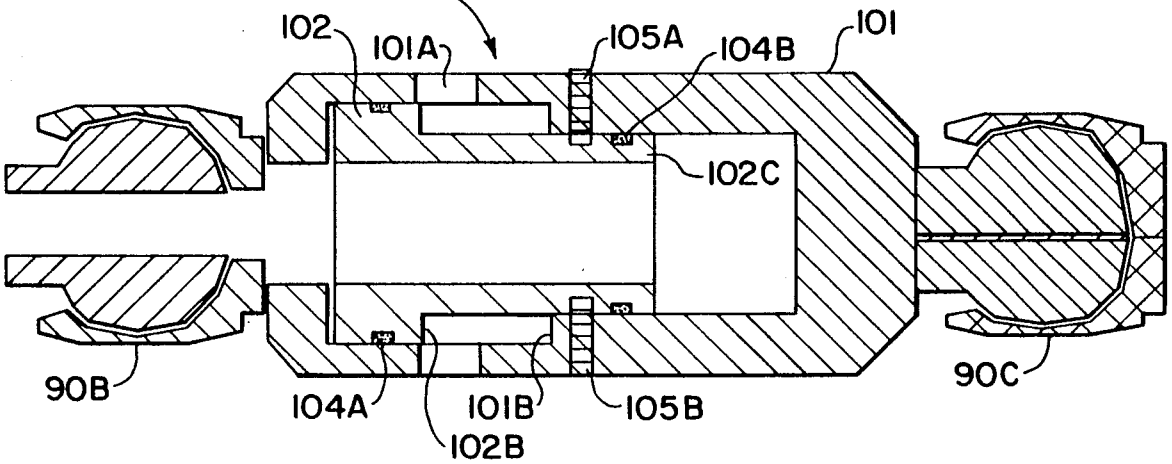

It will be understood by persons having ordinary skill in the art that the general toolstring concept described above may be used with other forms of tool units than those described with reference to FIGS. 9, 10 and 11. Of particular interest in this connection are the tool components or units being the subject of simultaneous and co-pending patent applications Nos. 07/689,512 and 07/689,513 being directed to a hydrostatic bailer and a chemical injection valve respectively.

We claim:

1. A method of performing an operation downhole in a high-deviation well, said well including a casing, a tubing element located withni said casing, a stop located in a lower portion of said tubing element, and an extension tubing element located downstream of said tubing element in said casing and extending throughout a high-deviation part of said well which is sharply angled with respect to the vertical, said tubing element establishing a circulation path in at least one direction with respect to a surface installation which effects pumpup and pumpdown movements of said toolstring within said tubing element, said method comprising the steps of:

(A) pumping an elongate, tubular toolstring element from the surface on which said surface installation is located down through a substantially vertical part of said tubing element of said well, said toolstring element having a leading end which is closed, a trailing end which is open, and locomotive devices provided at said leading end and said trailing end; then (B) pumping said toolstring element through a bent part of said tubing element; then (C) pumping said toolstring element into a part of said tubing element which is angled sharply with respect to said vertical part;

(D) establishing a stationary seal between said stop and seals located on said toolstring element, and establishing in an internal sliding seal between said seals and said toolstring element passing therethrough; then (E) pumping said toolstring element into said extension tubing element through said seals to transport said toolstring element to a point of desired operation within said extension tubing element; then (F) performing said downhole operation using said toolstring element; and then (G) reversing the direction of pumping of said toolstring element and returning said toolstring through said tubing element to said surface.

2. The method according to claim 1, wherein said downhole operation comprises applying a pressure in excess of a predetermined magnitude through said toolstring element to a circulation valve disposed at said leading edge of said toolstring element and breaking a mechanical locking device in said circulation valve to open said valve and to allow fluid flow therethrough.

3. The method according to claim 1 further comprising:

installing a circulation control valve in a nipple assembly during a normal production mode, said nipple assembly being provided in said tubing element and having a stop, and retrieving said circulation control valve from said nipple assembly before pumping said toolstring element into said tubing element.

4. A pumpdown toolstring for performing operations requiring application of power downhole in a high-deviation well, said well including a casing, a tubing element which is located within said casing and which has a stop which is located at a bottom end thereof and which includes a seat, and an extension tubing element which extends downstream of said tubing element and into a high-deviation part of said well which is sharply angled with respect to the vertical, said toolstring comprising:

(A) an elongated, tubular toolstring element having a closed leading end and an open trailing end, said toolstring element having a fluid passage connecting the outside of said toolstring element to the inside of said toolstring element;

(B) a first locomotive device which is provided at said leading end of said toolstring element and which pulls said toolstring element through said tubing element during a pumpdown operation, said first locomotive device including an external seal which cooperates with said seat of said stop, said first locomotive device further including an internal seal which selectively engages said seat and which surrounds said toolstring element and which allows sliding passage of said toolstring element through said first locomotive device when said internal seal engages said seat; and (C) a second locomotive device located proximate said trailing end of said toolstring element; wherein said toolstring element includes (i) a safety bypass valve which is located proximate said second locomotive device and which controls the opening of said fluid passage when said bypass valve is subjected to an axial compression exceeding a predetermined magnitude, (ii) a check valve, provided between said bypass valve and said second locomotive device, for preventing reverse flow of fluid toward said trailing end of said toolstring element, and (iii) a restrictor located between the inside and outside of said tubular element between said check valve and said trailing end of said toolstring element.

5. The toolstring according to claim 4, wherein said toolstring element comprises coiled tubing.

6. The toolstring according to claim 4, wherein said external seal has a substantially cylindrical outer surface which sealingly engages a substantially cylindrical seal bore in said stop.

7. The toolstring according to claim 6, wherein said outer surface of said external seal extends substantially to a front end face of said first locomotive device and, when said toolstring element is inserted into said well, rests against a stop shoulder formed in a bottom end of said seal bore.

8. The toolstring according to claim 4, wherein said internal seal is incorporated into an internal profile of said first locomotive device, said internal profile having a shape which maintains a seal between said first locomotive device and said toolstring element during bending of said toolstring element within said locomotive device.

9. The toolstring according to claim 8, wherein said internal seal includes two axially-spaced annular seals, and wherein said internal profile comprises a widened recess which is located between said annular seals and which has a significantly increased diameter in relation to the inner diameter of said internal annular seals, and widened portions between the respective annular seals and the adjacent ends of said first locomotive device.

10. The toolstring according to claim 9, wherein said safety bypass valve comprises an outer cylindrical housing which is mechanically and fluidly connected to said check valve and which has radial orifices formed therein, a cylindrical slide member which is positioned within said housing, which is mechanically and fluidly connected with said trailing end of said toolstring element, and which has radial orifices formed therein, seals located at an interface between said housing and said slide member, and a mechanical locking device which breaks when said axial compression exceeds said predetermined magnitude, which normally maintains said slide member in a position in which said orifices of said housing do not communicate with said orifices of said slide member, and which, when broken, releases said slide member and allows movement of said slide member to a position in which said orifices of said housing communicate with said orifices of said slide member, thereby opening said fluid passage from the inside of the outside of said toolstring element.

11. The toolstring according to claim 4, wherein said restrictor comprises a radial bleed orifice formed in the top end of said check valve.

* * * * *